US006706985B2

(12) United States Patent
Chun

(10) Patent No.: US 6,706,985 B2
(45) Date of Patent: Mar. 16, 2004

(54) KEY SWITCH

(75) Inventor: Gyu Chul Chun, Iksan City (KR)

(73) Assignee: SMK Korea Co., Ltd., Iksan (KR)

( * ) Notice: Subject to any disclaimer, the term of this patent is extended or adjusted under 35 U.S.C. 154(b) by 16 days.

(21) Appl. No.: 10/435,294

(22) Filed: May 9, 2003

(65) Prior Publication Data

US 2003/0213684 A1 Nov. 20, 2003

(30) Foreign Application Priority Data

May 15, 2002 (KR) ..... 10-2002-0026724

(51) Int. Cl.[7] ..... H01H 13/70
(52) U.S. Cl. ..... 200/344
(58) Field of Search ..... 200/5 A, 517, 200/344, 345; 400/490, 491, 491.2, 495, 495.1, 496

(56) References Cited

U.S. PATENT DOCUMENTS 6,100,482 A * 8/2000 Koma et al. ..... 200/344
6,118,092 A * 9/2000 Hayashi ..... 200/344
6,300,583 B1 * 10/2001 Hsu ..... 200/344
6,444,933 B1 * 9/2002 Chun ..... 200/344
6,534,736 B1 * 3/2003 Lee et al. ..... 200/344
6,586,695 B2 * 7/2003 Sato et al. ..... 200/344

FOREIGN PATENT DOCUMENTS

JP 9190735 A2 7/1997 ..... H01H/13/14

* cited by examiner

*Primary Examiner*—Michael A. Friedhofer
(74) *Attorney, Agent, or Firm*—Green, Winner and Sullivan, P.C.

(57) ABSTRACT

The key switch includes a key, a linkage assembly having first and second linking members with arms connected to outer ends thereof, and a bow-shaped elastic object connected between the arms, which is lowered and raised with the key, the first and second linking members including a coupling recess and a coupling protrusion and inner end thereof and hinge protrusions at side surfaces thereof, the coupling recess and protrusion being engaged with each other to constitute a linkage rotating shaft, a frame including hinge hooks engaged with the hinge protrusions, and an FPC placed on the frame for operation by contact with the linkage assembly. As the key is operated, the arms rotated downward while the linkage rotating shaft rises, and the elastic object gradually flattens and then bends into an upwardly convex bow shape, thereby providing a clicking sensation and a restoring force to the linkage assembly.

4 Claims, 6 Drawing Sheets

KEY SWITCH

CROSS-REFERENCE TO RELATED APPLICATIONS

This application takes priority from Korean Application No. 10-2002-0026724 filed May 15,2002.

BACKGROUND OF THE INVENTION

1. Field of the Invention

The present invention relates to a key switch for use in an input device such as a keyboard of a PC (Personal Computer), and more particularly to a key switch which is intended to realize a compact and slim keyboard and to enable a high keystroke rate and a resilient clicking sensation to a user via its simple configuration, thereby affording reliable key-input performance. The present invention also relates to a key switch, which is simplified in its construction so as to be produced by a simple manufacturing process.

2. Description of the Prior Art

These days, keyboard keys have been thinned and flattened to comply with needs for compact keyboards, and a high keystroke rate and a reliable and clear clicking sensation are required to enhance ease and reliability of a key-input operation. There are proposed various key switches for use in such keyboards.

For example, Japanese Patent Laid-Open No. 9-190735 discloses a key switch, described hereinafter.

In the key switch disclosed in the above Japanese Patent Laid-Open, a guide assembly for guiding an up-and-down motion of a keyboard key is comprised of first and second linking members. The first and second linking members are provided at lower facing ends thereof with teeth engaging with each other, and are connected at upper ends thereof to the top of key, to be slid along a lower surface thereof. Accordingly, when the key is pushed downward, the upper ends of the first and second linking members move far away from each other while sliding along the lower surface of the key. By this movement, the teeth of the first and second linking members are rotated while being engaged with each other. As the key is depressed, a resilient rubber actuator provided between the key and a base housing is pressed by the key, and the lowering actuator comes into contact to a contact of a membrane switch, thereby causing the key-input operation to be recognized. Upon release of the pushing force acting on the key, the pressed actuator is restored to its normal position while pushing the key upward, thereby allowing the key to be restored to its normal position.

The above-described key switch is advantageous in that the first and second linking members do not intersect in a "X" form, thereby affording simplification of the link guide assembly.

However, since the conventional key switch, as disclosed in the Japanese Patent Laid-Open, is equipped with a rubber actuator, the key switch inevitably becomes large.

Furthermore, since the key switch requires an additional rubber actuator, which is produced separately from the linking members, its manufacturing process is complicated.

In addition, since the key switch employs an actuator, which is configured to be simply pressed and to provide only a linear repulsion to the key, an acceptable clicking sensation cannot be achieved.

SUMMARY OF THE INVENTION

Accordingly, the present invention has been made keeping in mind the above problems occurring in the prior art, and an object of the present invention is to provide a key switch in which linking members of a linkage assembly are provided at connecting portions thereof with a connecting groove and protrusion, which serve as rotating shaft to simplify a structure of the linkage assembly, and in which the linkage assembly and means for restoring a keyboard key are integrally formed to achieve an acceptable clicking sensation and a compact key switch.

In order to accomplish the above object, the present invention provides a key switch comprising a keyboard key which is pressed down by a user's finger, a linkage assembly comprised of a first linking member with an arm connected to an outer end thereof, a second linking member with an arm connected to an outer end thereof, and a downwardly convex bow-shaped elastic object connected between the arms of the first and second linking members, which is lowered by pressure of the key to cause a key-input operation to be recognized and is raised together with the key by release of the pressure on the key, one of the first and second linking members including a coupling recess at its inner end and a hinge protrusion at its side surface, and the other of the first and second linking members including a coupling protrusion at its inner end and a hinge protrusion at its side surface, the coupling recess and protrusion being engaged with each other to constitute a linkage rotating shaft, a frame including hinge hooks engaged with the hinge protrusions of the first and second linking members, and an FPC (Flexible Printed Circuit) placed on the frame, which enables a key-input operation to be recognized via contact with the linkage assembly, wherein, as the key is pressed down, the arms of the first and second linking members are rotated downward around the linkage rotating shaft while the linkage rotating shaft is raised, and the elastic object is gradually flattened and then bent into an upwardly convex bow shape, thereby providing a clicking sensation to a user and a restoring force to the linkage assembly.

The keyboard key may be provided at its lower surface with ribs, each of which include an elongated linkage guide hole and a support cut, and each of the first and second linking members may be provided at its outer end with a key-positioning protrusion and a support knob, each key-positioning protrusion being slid along a link guide hole when the key is depressed, the support knob continuously supporting the key from the time when the key is positioned at its uppermost level.

The elastic object may be provided at its lower surface with a contact protrusion to reliably push a contact portion of the flexible printed circuit.

The key switch may further include a linkage bar disposed under the key to support the key and to evenly distribute pushing force acting on the key, wherein a rotating axis of the linkage bar is positioned to have an angle of 90° with respect to a rotating axis of the linkage assembly, so that the linkage bar does not interfere with the linkage assembly.

BRIEF DESCRIPTION OF THE DRAWINGS

The above and other objects, features and advantages of the present invention will be more clearly understood from the following detailed description taken in conjunction with the accompanying drawings, in which:

FIGS. 4A to 4C are side views and schematic views of the key switch according to the present invention, in which FIG. 4A shows the key switch in its initial position, FIG. 4B shows the key switch in a lowering state, and FIG. 4C shows the key switch in its fully depressed state;

FIG. 5 are schematic views of arms of first and second linking members, and a rotating protrusion of the key switch according to the present invention, in which

DETAILED DESCRIPTION OF THE INVENTION

This invention will be described in further detail by way of example with reference to the accompanying drawings.

Figure 1:
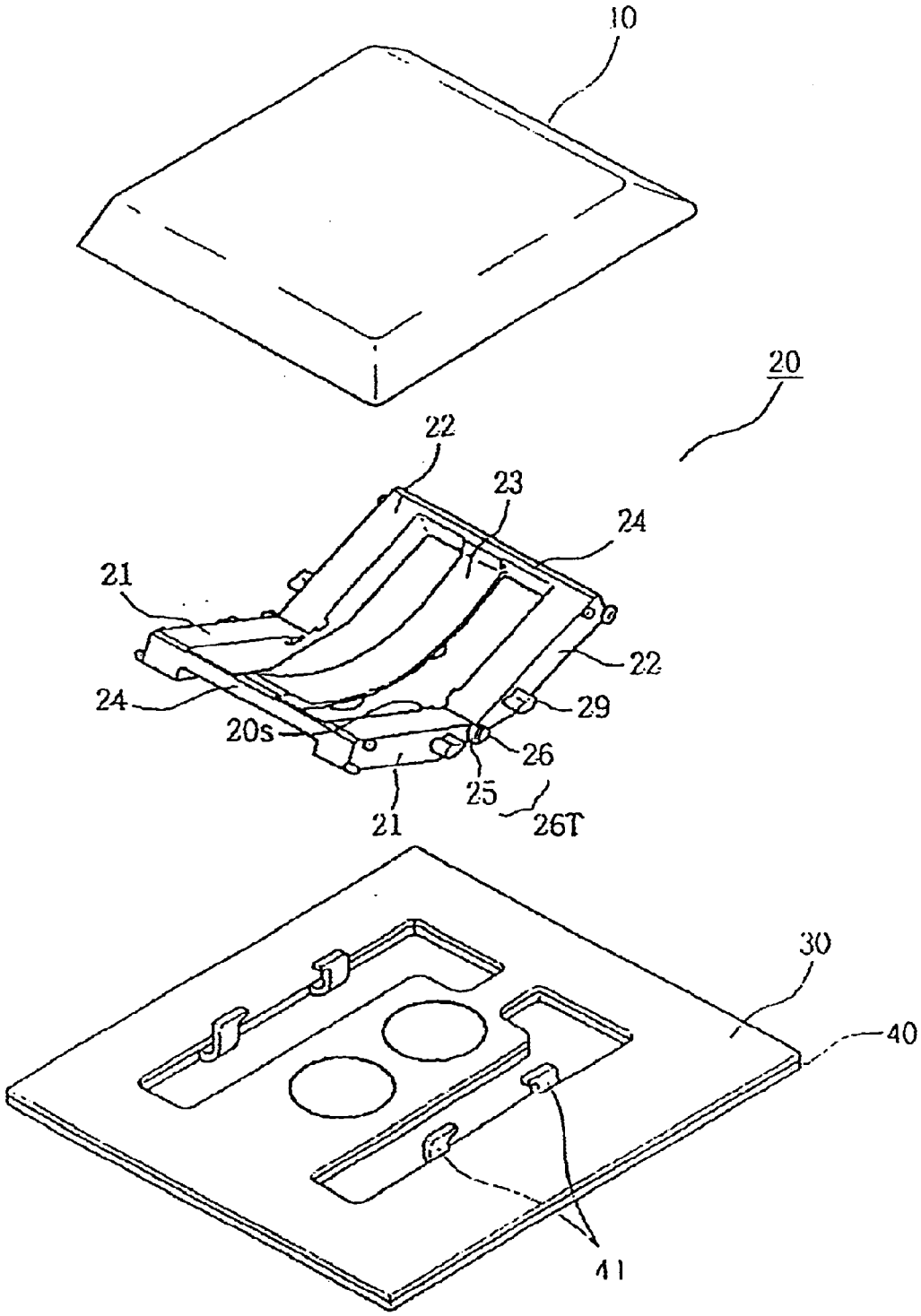
FIG. 1 is an exploded perspective view of a key switch according to the present invention.
Figure 2:
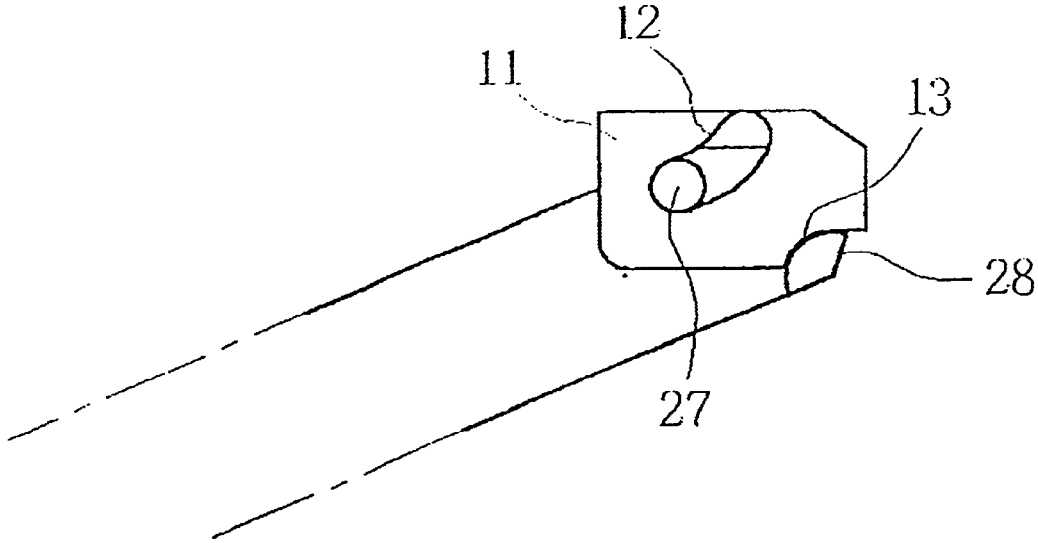
FIG. 2 is a partial side view showing a coupling structure between a rib of a key and a linking member.
Figure 3:
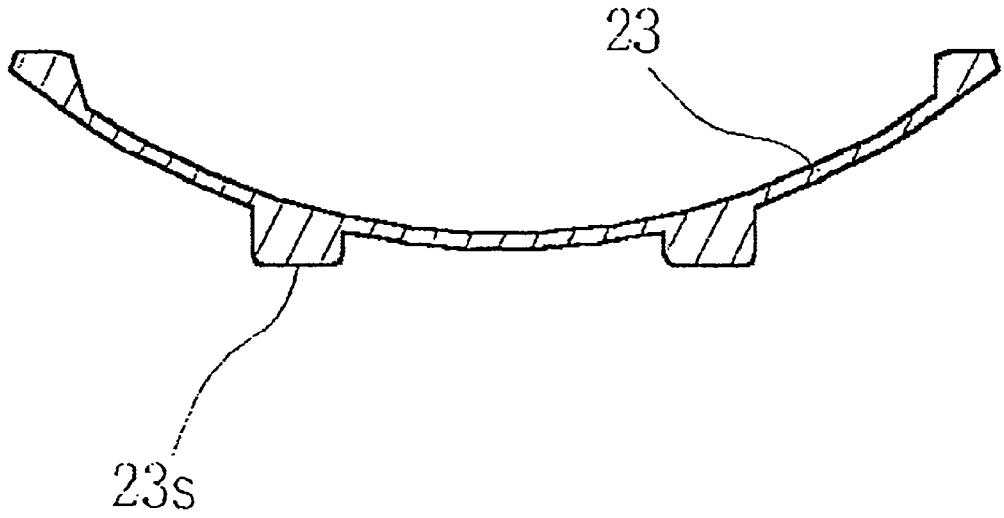
FIG. 3 is a cross-sectional view of a leaf spring with contact protrusions, according to the present invention.

FIG. 1 is an exploded perspective view of a key switch according to the present invention, FIG. 2 is a fragmentary side view showing a coupling portion between a key 10 and a linking member 20, and FIG. 3 is a side cross-sectional view showing contact protrusions 23*s* of a leaf spring 23 serving to restore the key to its normal position.

As shown in FIG. 1, the key switch of the present invention comprises a key 10, a linkage assembly 20, a FPC (flexible printed circuit) 30 and a frame 40, which are positioned in order, from top to bottom, in the drawing.

The keyboard key 10 is mounted on an upper surface of a keyboard, and is printed on its upper surface with numeric characters (0, 1, 2, 3, - - - ), alphabet characters (a, b, c, - - - , @, #, - - - ) or functional indications (Esc, Ctrl, Alt, Home, PgUp, - - - ). The key 10 is depressed by a user's finger to send a key signal to a PC, and then resiliently raised to its normal position by elasticity of the linkage assembly 20. The key 10 is generally formed into an approximately cubic shape, and is made of a hard plastic material.

The linkage assembly 20 serves to guide an up-and-down motion of the key 10, and is adapted to be opened at its outer ends 24 while being flattened at its leaf springs 23 by pressure of the key 10, thereby providing a clicking sensation to a user.

The FPC 30 is comprised of a matrix circuit, which is adapted to recognize a character printed on the associated key 10 when its contact point comes into contact with a lower contact point of the linkage assembly 20 by a lowering motion of the key 10.

The frame 40 includes a coupling mechanism for coupling the linkage assembly 20 thereto, and supports the linkage assembly 20 and thus the key 10.

The above-mentioned coupling mechanism and components of the linkage assembly 20 will now be described.

The key 10 is provided at its lower surface with four ribs 11 so as to allow the key 10 to be coupled to the linkage assembly 20. The ribs 11 are formed into a rectangular shape, and provided at four corners of the lower surface of the key 10, respectively. Each of the ribs 11 is formed with a linkage guide hole 12 and a linkage support cut 13. The linkage guide hole 12 is elongated into an arc shape, and receives a key-positioning protrusion 27 therein, so as to convert a lowering movement of the key 10 into a horizontal movement. The linkage support cut 13 is formed into an arc shape, and is in contact with a support knob 28 of the linkage assembly 20 so that a lowering movement of the key 10 causes both ends of the linkage assembly 20 to be moved outwardly. That is, when the key 10 is lowered, the support knob 28 of the linkage assembly 20 is moved to an outer and upper surface of the linkage support cut 13 while sliding along the surface of the linkage support cut 13.

The linkage assembly 20 will now be described.

The linkage assembly 20 comprises a pair of first linking members 21 with an arm 24 connected between outer ends thereof, a pair of second linking members 22 with an arm 24 connected between outer ends thereof, and a leaf spring 23 connected between the arms of the first and second linking members 21 and 22, all of which are integrally formed.

Each of the first linking members 21 is provided at its inner end with a coupling recess 25, and each of the second linking members 22 is provided at its inner end with a rotating protrusion 26, both of which are engaged with each other to form a linkage rotating shaft 26T. When the key 10 is lowered, the first linking members 21 are rotated counterclockwise about the linkage rotating shaft 26T while the second linking members 22 are rotated clockwise around the linkage rotating shaft 26T. Each of the first and second linking members 21 and 22 is provided between its outer end and the linkage rotating shaft 26T with a hinge protrusion 29, which is rotatably retained in a hinge hook 41 of the frame 40. Accordingly, when the key 10 is lowered, the inner ends of the first and second linking members 21 and 22 are moved upward about hinge protrusions 29 thereof.

The hinge protrusions 29 of the first and second linking members 21 and 22 are symmetrically engaged in the hinge hook 41, so that the hinge protrusions 29 are horizontally slid in the hinge hooks 41 when the arms 24 of the first and second linking members 21 and 22 are rotated outwardly about the linkage rotating shaft 26T. At this point, the key-positioning protrusions 27 and the support knobs 28 are equally rotated outwardly about the rotating axis while being lowered, and the ribs 11 engaged with the key-positioning protrusions 27 and the support knobs 28 are uniformly lowered, thereby allowing the key 10 to be constantly maintained in the horizontal position.

Each of the first and second linking members 21 and 22 is provided with a stopper 20*s* at the side opposite to the side having the hinge protrusion 29, so as to prevent the linkage assembly 20 from being lowered under the frame 40 in cooperation with the hinge protrusions 29.

The arms 24 are provided at opposite ends thereof with the key-positioning protrusions 27 and the support knobs 28, respectively. Each of the key-positioning protrusions 27 has a circular section, and is received in the corresponding link guide hole 12. When the key 10 is depressed by a user's finger, the key-positioning protrusions 27 are moved outward and upward in the link guide holes 12. Each of the support knobs 28 has a bow-shaped section, and serves to transmit a lowering force of the key 10 to the linkage assembly 20. The support knobs 28 are always in contact with the linkage support cuts 13. Therefore, when the key 10 is lowered, the lowering force of the key 10 is transmitted to the support knobs 28, and the support knobs 28 are moved outward while sliding along arched surfaces of the linkage support cuts 13. When the support knobs 28 are rotated downward around the linkage rotating shafts 26T, the key-positioning protrusions 27 are rotated along bow-shaped trajectories about the support knobs 28. At this point, since the key-positioning protrusions 27 of the first and second linking members 21 and 22 are symmetrically moved, a center line of the linkage assembly 20 always coincides with a center line of the key 10. Since the key-positioning knobs 28 are positioned at opposite sides of the key 10 and rotated about the linkage rotating shaft 26T, it is possible to obtain high keystroke even though the linking members are rotated within a relatively small rotation angle. Since the linkage support cuts 13 are supported on the support knobs 28 from its initial operation, a high keystroke can be achieved.

The leaf spring 23 is connected between center portions of the arms 24 of the first and second linking members 21 and 22. The leaf spring 23 is bent into an arcuate form to upwardly bias the arms 24 of the linkage assembly 20.

The frame 40 is provided with the hinge hooks 41 to be engaged with the hinge protrusions 29 of the linkage assembly 20 so as to prevent the linkage assembly 20 from being separated from the frame 40. Furthermore, the frame 40 is formed with receptive holes to receive the linking members 21 and 22 therein. Accordingly, when the arms 24 of the linking members 21 and 22 are lowered by the key 10 being downwardly depressed, the linking members 21 and 22 of the linkage assembly 20 are completely received in the reception holes of the frame 40, thereby enabling an overall height of the resulting key switch to be reduced.

An up-and-down movement of the key switch according to the present invention will now be described with reference to FIGS. 4A to 4C.

Figure 4A:
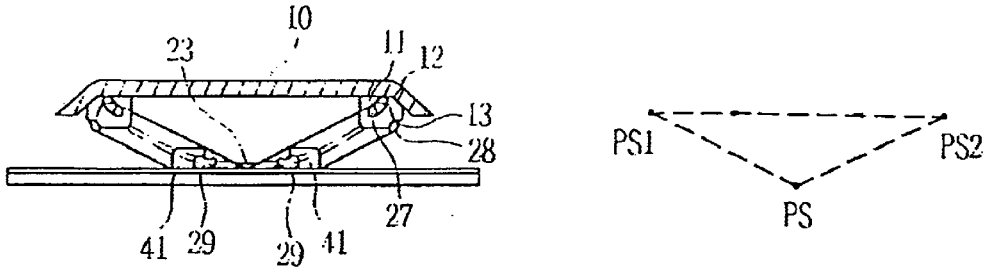
Figure 4B:
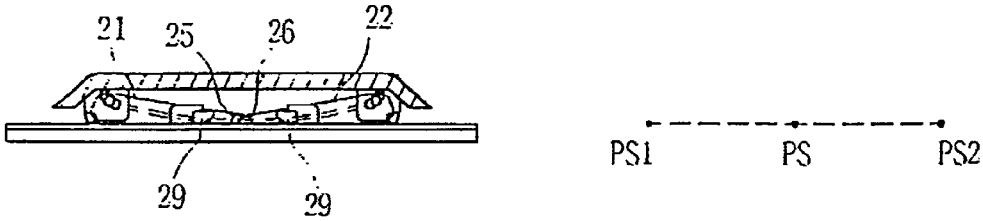
Figure 4C:
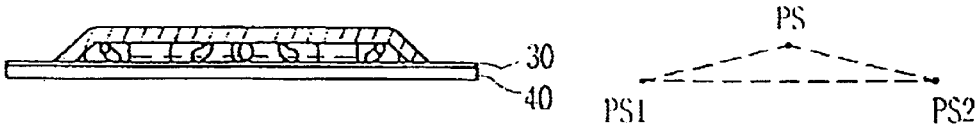

FIG. 4A shows the key 10, which is positioned at its uppermost level by resiliency of the leaf spring 23 because the key 10 is not subjected to a pushing force. In this case, the key-positioning protrusions 27 are positioned at inner and lower ends of the link guide holes 12.

When a pushing force is applied to the key 10, the support knobs 28 engaging with the linkage support cuts 13 are rotated downward. At this point, biasing force of the leaf spring 23 and resiliency of the linkage assembly 20 are further intensified. When the opposite connecting points (PS1 and PS2) of the leaf spring 23 and the rotating axis point (PS) are aligned on a straight line, as shown in FIG. 4B, a lifting force of the linkage assembly 20 (a lifting force of the key) is abruptly decreased, thereby providing a clicking sensation to a user. Subsequently, the key 10 comes into contact with the frame 40, thereby preventing a further lowering movement of the key 10, as shown in FIG. 4C. At this point, contact protrusions 23*s* of the leaf spring 23 (see FIG. 3) push the FPC 30, thereby causing a key-input signal to be recognized. At the same time, since the leaf spring 23 is bent into a reverse shape of its normal shape, the lifting force acting on the linkage assembly 20 is further increased.

Upon releasing the pushing force from the key 10, the key 10 and the linkage assembly 20 are restored to their initial normal positions, as shown in FIG. 4A.

A principle of providing a clicking sensation and a restoring force by the key switch according to the present invention will now be described with reference to FIGS. 5 to 7.

Figure 5A:
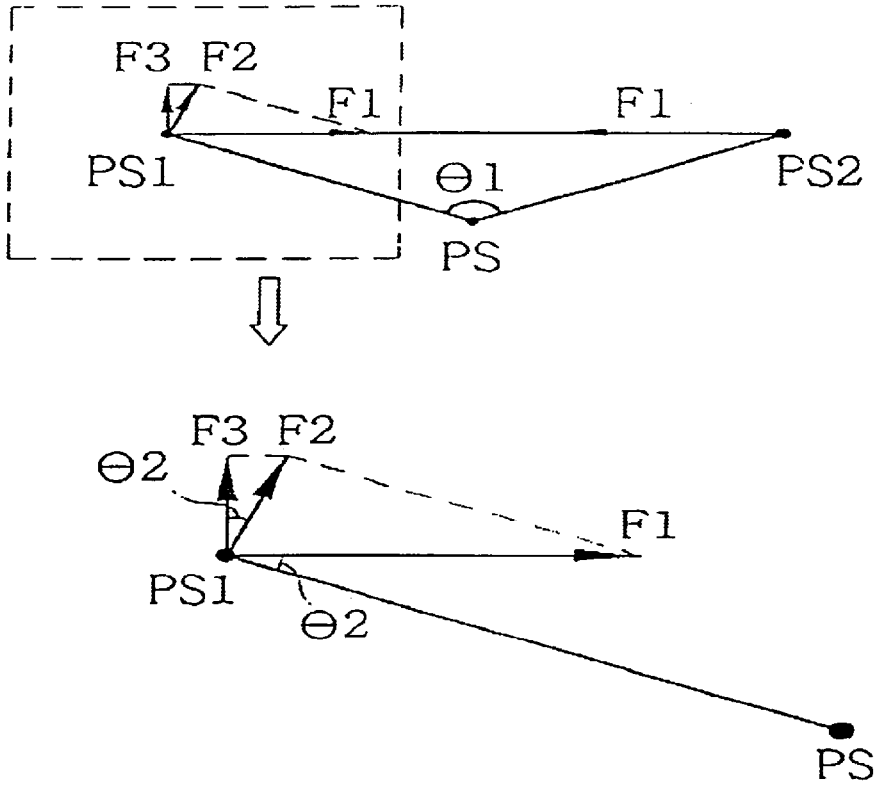
FIG. 5A shows an initial normal state thereof.
Figure 5B:
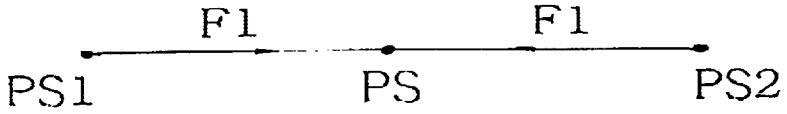
FIG. 5B shows a lowering state thereof.
Figure 5C:
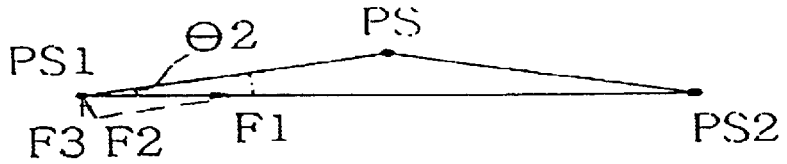
FIG. 5C shows a lowermost state thereof.

FIG. 5 shows the arm 24 (PS1) of the first linking member 21, the arm 24 (PS2) of the second linking member 22, and the rotating protrusion 26 (PS), which are positioned at an initial normal state thereof (FIG. 5A), at a lowering state thereof (FIG. 5B), and at a lowermost state thereof (FIG. 5C).

In the initial state (FIG. 5A), a point (PS1) designating the arm 24 of the first linking member 21 and a point (PS2) designating the arm 24 of the second linking member 22 are positioned above a point (PS) designating the rotating protrusion 26, thereby defining an inverted triangle. As the linking members 21 and 22 are rotated downward, a length of a line defined between the point (PS1) and the point (PS2) is varied while a line defined between the point (PS1) and the point (PS) and a line defined between the point (PS2) and the point (PS) are maintained at a constant length. The variation of the length of the line (PS1–PS2) results from deformation of the arched leaf spring into a linear state and bending deformation of portions of the arms 24 to which the leaf spring is connected.

In FIG. 5A, showing an initial state of the key switch according to the present invention, there is present a force (F1) resulting from resiliency due to initial deformations of the leaf spring 23 and the portions of the arms 24 (a resisting force against the deformations).

The extent of F1 is proportional to a length of a line (PS1–PS2), which is varied as the first and second linking members 21 and 22 are rotated downward. Accordingly, F1 is rapidly varied (increased) in an initial lowering stage of the key 10 and then gradually decreased. When the first and second linking members 21 and 22 are rotated to a state shown in FIG. 5B, that is, when the points (PS1, PS2 and PS) are aligned on a straight line, a variation of a length of the line (PS1–PS2) becomes zero, and an extent of F1 is constant. As the key 10 is further lowered, the line (PS1–PS2) is decreased, thereby reducing an extent of F1.

More specifically, as the key 10 is gradually lowered from its normal state, F1 tendancy to restore the arms 24 toward the point (PS) designating the rotating protrusion 26 is generated. F1 may be decomposed into a component F2, which tends to rotate the points (PS1 and PS2) upward. That is, F2 may be expressed by the following Equation: $F2=F1 \sin \theta 2$, wherein F2 may be further decomposed into a reaction force F3. F3 may be expressed by the following Equation: $F3=F2 \cos \theta 2$.

Since force that is felt by a user is F3 when the key 10 is pushed downward, F3 is varied according to F2, which is varied by variation of F1 and a position of the linking members 21 and 22. In an initial stage, F1 is rapidly increased thereby rapidly increasing F3 by a rapid variation of a length of a line (PS1–PS2).

As a variation rate of a length of line (PS1–PS2) is decreased, an increasing rate of F1 is also decresed. As the linking members 21 and 22 are rotated downward, an angle $\theta 1$ is highly increased while an angle $\theta$ 2 is rapidly decreased, thereby rapidly decreasing F3 and thus F3. In a state shown in FIG. 5B, in which $\theta 2$ becomes zero so that the points (PS1, PS2 and PS) are aligned in a straight line, an reaction force F3 decomposed from F1, which is caused by a variation of a length of the leaf spring 23 and deformation of the portions of the arms 24, is zero. Consequently, since only a reaction force caused by a lifting force by deformation of the leaf spring remains, a variation rate of F3 is abruptly increased, thereby providing a clicking sensation to a user.

When the key 10 is further lowered from a position shown in FIG. 5B, F3 serves as a negative force to pull the key 10 down, as can be seen in FIG. 5C.

At this time, if there is not an additional positive force to raising the key 10, the key 10 cannot be restored to its normal position.

When the key 10 is lowered to its lowermost level as shown in FIG. 5C, the contact protrusions 23*s* provided at a lower surface of the leaf spring 23 come into contact with the FPC contact portion, thereby causing a rapid deformation of the leaf spring 23. Accordingly, the deformation of the leaf spring 23 enables the key 10 to be restored to its normal position.

Figure 6:
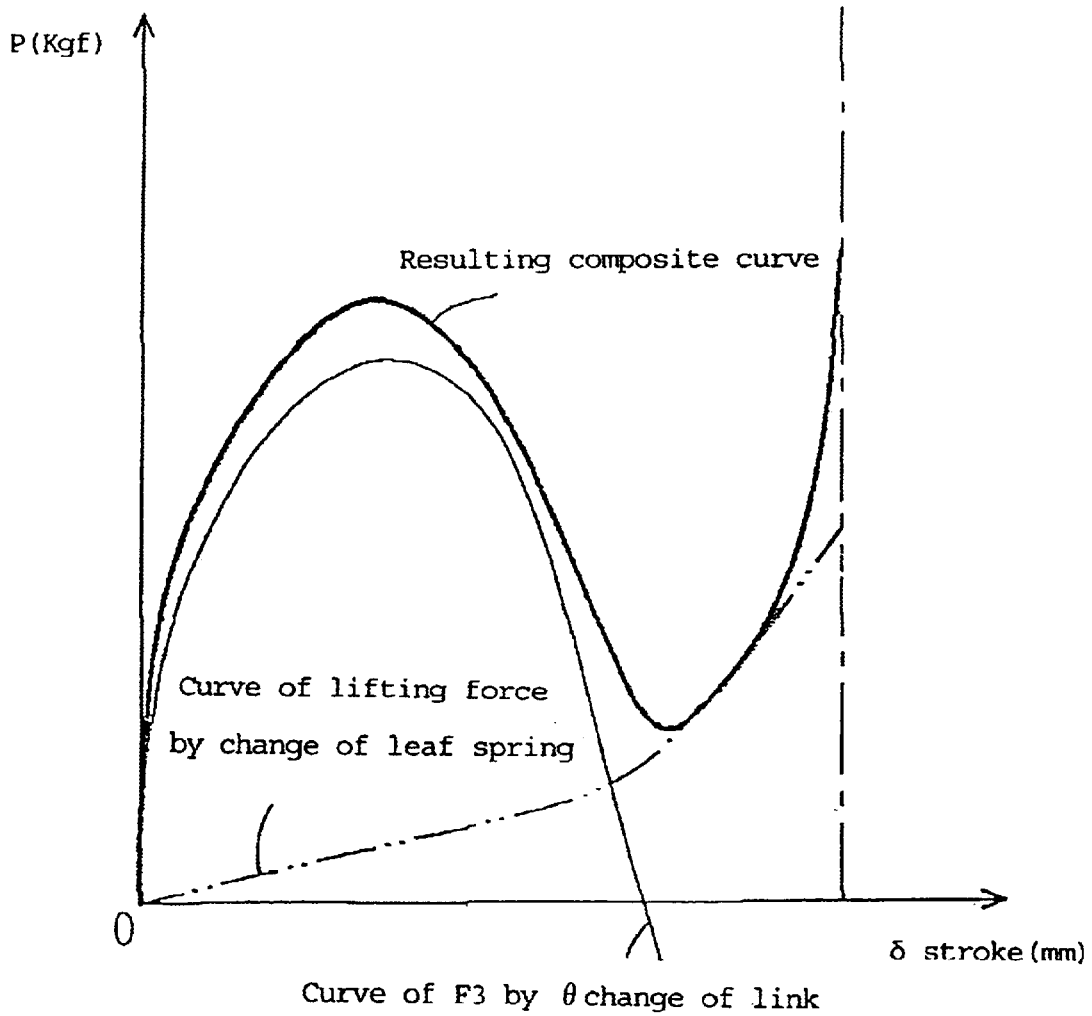
FIG. 6 is a graph showing a relation between pushing force acting on the key and a keystroke.

FIG. 6 is a graph showing a relation between pushing force acting on the key 10 and a keystroke.

A key switch applied to a so-called 'multiple key, such as a 'Space bar,' a 'Shift' key or an 'Enter' key, which are larger than usual keys, will now be described with reference to FIG. 7.

To enable the linkage assembly 20 to support a whole lower surface of a multiple key, the linkage assembly 20 must be enlarged according to the area of the multiple key. In this case, the linkage assembly 20 is positioned under the key to support a part of the key, and an additional linking bar is provided under the remaining portion of the key to support the remaining portion.

Figure 7:
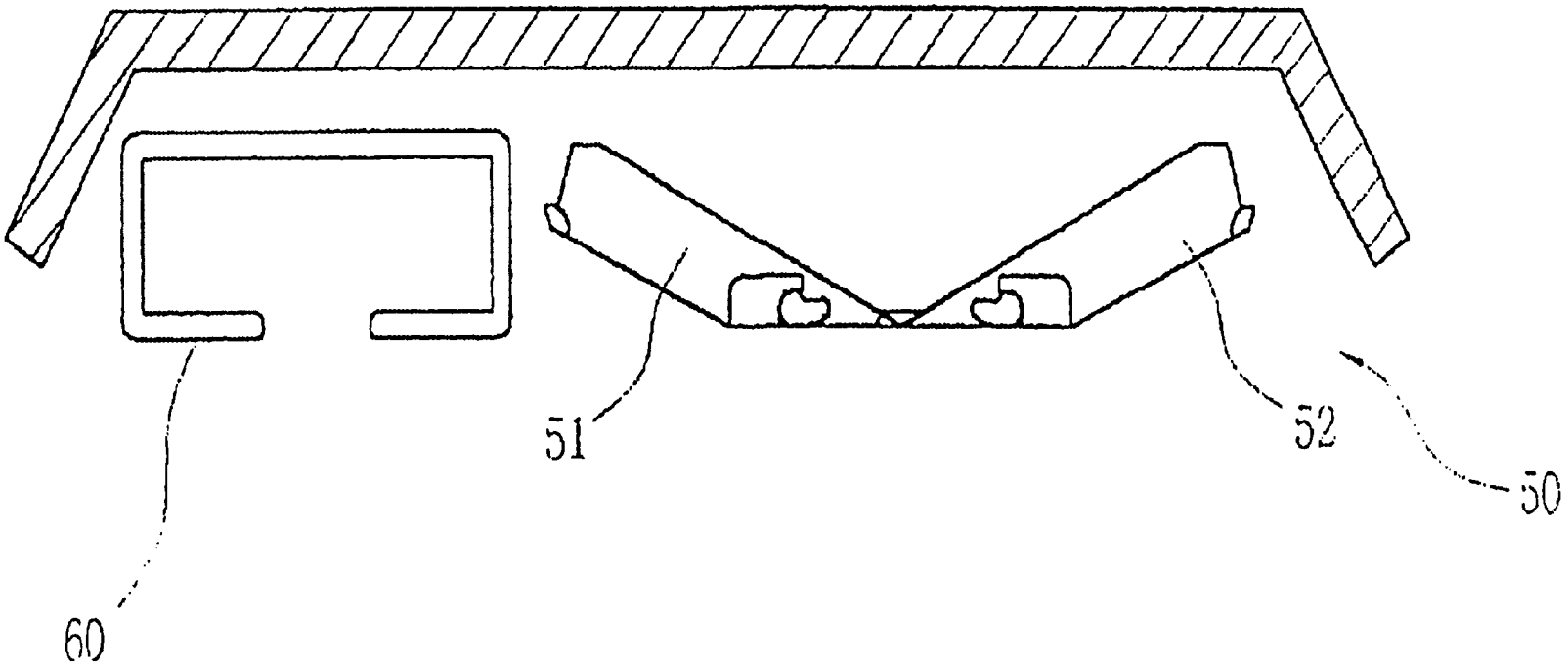
FIG. 7 is a side view of a multiple key to which a key switch and a linking bar according to the present invention are applied.

As shown in FIG. 7, the linking bar 60 is made of a steel wire to have a rectangular shape with an opening lower side. The linking bar 60 supports a portion that is not supported by the linkage assembly 50, and serves to evenly distribute pushing force acting on the key 10 over the entire area of the key 10.

In this embodiment, the linkage assembly 50 includes a first linking member 51 and a second linking member 52, which are configured to be asymmetrical in length. If the linking members used in a multiple key are symmetrically configured, an angle defined between both the linking members is increased. Due to the increased angle, a variation rate of a length between contact points of the leaf spring 23 is decreased when the key 10 is depressed, thereby decreasing its service life and resistibility to various dimensional changes.

Contrary to the symmetrical configuration, when the linking members are asymmetrically configured, the angle defined between both the linking members can be maintained as little as possible, and thus a variation rate of a length between opposite ends of the leaf spring is increased, thereby improving its service life.

In this embodiment, since a rotating axis between inner ends of the linking members is positioned to have an angle of about 90° with respect to a rotating axis of the linking bar 60, the linking bar 60 does not interfere with the linkage assembly 50.

Where the linking bar and the linkage assembly are positioned to interfere with each other, a size of the linkage assembly must be reduced. Therefore, a pushing property of a key may be deteriorated when the key is locally pressed. To overcome this problem, this embodiment prevents the linking bar and the linkage assembly from interfering with each other, thereby enabling the linkage assembly to be considerably enlarged.

Furthermore, an arrangement of the linkage assembly 50 and the linking bar 60 may be embodied in various manners. That is, one linking bar 60 and one linkage assembly 50 may be provided to be replaced with each other, or two linking bars 60 and one linkage assembly 50 disposed between the two linking bars 60 may be provided.

As described above, the present invention provides a key switch which can be easily produced at a low production cost by simplifying a structure of its linkage assembly and by connecting first linking members and second linking members via a simplified coupling means, comprised of a coupling recess and a coupling protrusion engaging with each other.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A key switch comprising:

a key which is pressed down by a user's finger;

a linkage assembly comprised of a first linking member with an arm connected to an outer end thereof, a second linking member with an arm connected to an outer end thereof, and a downwardly convex bow-shaped elastic object connected between the arms of the first and second linking members, which is lowered by pressure of the key to cause a key-input operation to be recognized and is raised together with the key by release of the pressure on the key, one of the first and second linking members including a coupling recess at an inner end and a hinge protrusion at a side surface, and the other of the first and second linking members including a coupling protrusion at an inner end and a hinge protrusion at its side surface, the coupling recess and protrusion being engaged with each other to constitute a linkage rotating shaft;

a frame including hinge hooks engaged with the hinge protrusions of the first and second linking members; and an FPC (Flexible Printed Circuit) placed on the frame, which enables a key-input operation to be recognized by contact with the linkage assembly, wherein, as the key is pressed down, the arms of the first and second linking members are rotated downward around the linkage rotating shaft while linkage rotating shaft is raised, and the elastic object is gradually flattened and then bent into an upwardly convex bow shape, thereby providing a clicking sensation to a user and a restoring force to the linkage assembly.

2. The key switch as set forth in claim 1, wherein the key is provided at a lower surface with ribs, each of which includes an elongated link guide hole and a support cut, and each of the first and second linking members is provided at the outer end with a key-positioning protrusion and a support knob, the key-positioning protrusions being slid along the link guide holes when the key is lowered, the support knob continuously supporting the key from when the key is positioned at an uppermost level.

3. The key switch as set forth in claim 1, wherein the elastic object is provided at a lower surface with a contact protrusion to reliably push a contact portion of the FPC.

4. The key switch as set forth in claim 1, further comprising a linking bar disposed under the key to support the key and to evenly distribute pushing force acting on the key, wherein a rotating axis of the linking bar is positioned to have an angle of 90° with respect to a rotating axis of the linkage assembly, so that the linking bar does not interfere with the linkage assembly.

* * * * *